United States Patent [19]

Morgan et al.

[11] 4,254,755

[45] Mar. 10, 1981

[54] BALL THROWING MACHINE USEFUL IN PRACTICING THE GAME OF VOLLEYBALL

[76] Inventors: Steven R. Morgan, R.R. 2, Box 48H; Dwayne E. Reese, R.R 2, Box 35L, both of Ogallala, Nebr. 69153

[21] Appl. No.: 16,321

[22] Filed: Feb. 28, 1979

[51] Int. Cl.[3] ..... A41B 7/00

[52] U.S. Cl. ..... 124/6; 124/41 R; 124/49; 124/7; 267/136

[58] Field of Search ..... 124/17, 16, 36, 41 R, 124/50, 49, 29, 6, 7; 280/47.26, 47.24; 298/2, 3; 414/748; 221/285; 267/136

[56] References Cited

U.S. PATENT DOCUMENTS

| | | | |
|---|---|---|---|
| 2,562,462 | 7/1951 | Jackson | 124/36 X |
| 2,815,743 | 12/1957 | Brunderman . | |
| 3,128,752 | 9/1953 | Farre . | |
| 3,262,439 | 7/1966 | Johns . | |
| 4,036,203 | 7/1977 | Chapman | 124/29 X |
| 4,043,487 | 8/1977 | Price | 222/166 |
| 4,122,822 | 10/1978 | Scheiwiller | 124/36 X |

*Primary Examiner*—Richard C. Pinkham
*Assistant Examiner*—William R. Browne
*Attorney, Agent, or Firm*—Shanley, O'Neil and Baker

[57] ABSTRACT

Apparatus is disclosed which is operable to either set or serve balls on various trajectories to facilitate a player's practice of the game of volleyball. A guide trough supplies balls to the striking position, and a motor drives the apparatus to strike successive balls, at predetermined intervals, to provide maximum utilization of a player's time during practice. The apparatus may be adjusted to vary the force delivered to the balls and to vary the trajectory as desired.

15 Claims, 8 Drawing Figures

FIG. 1
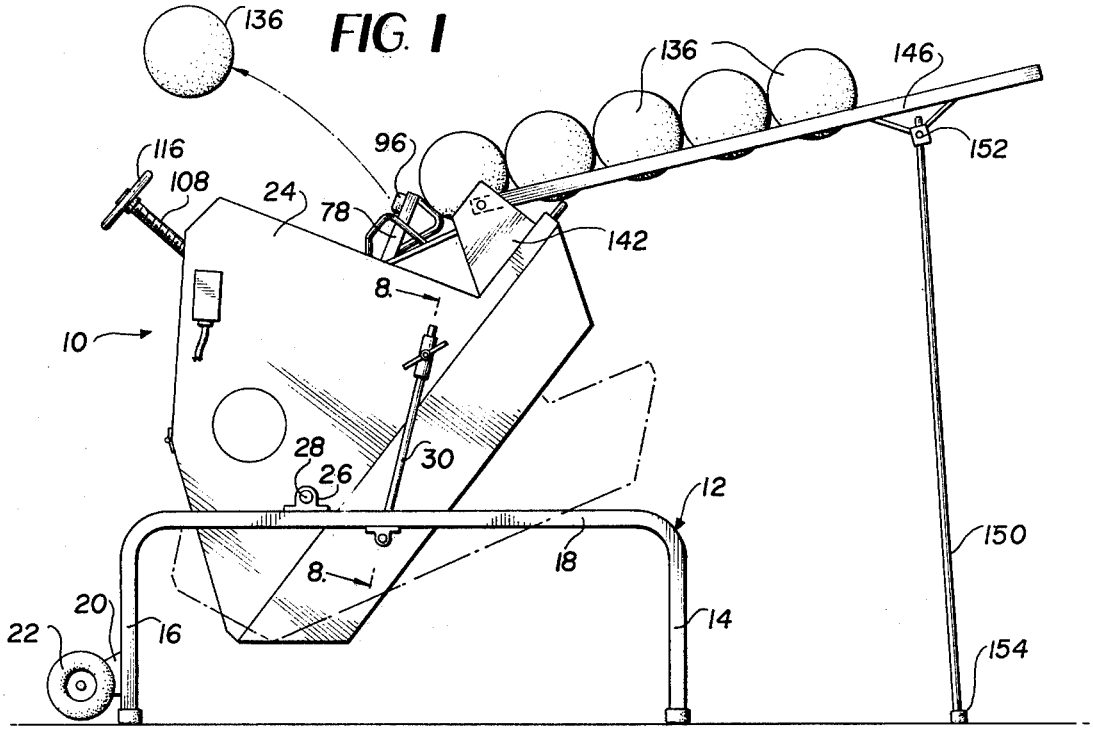
FIG. 2
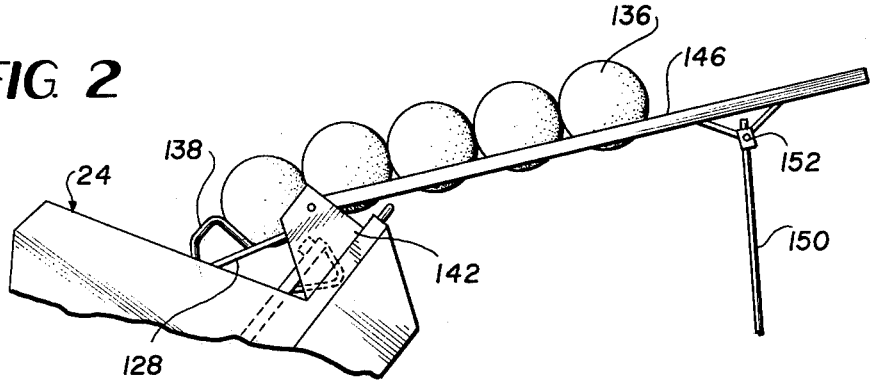
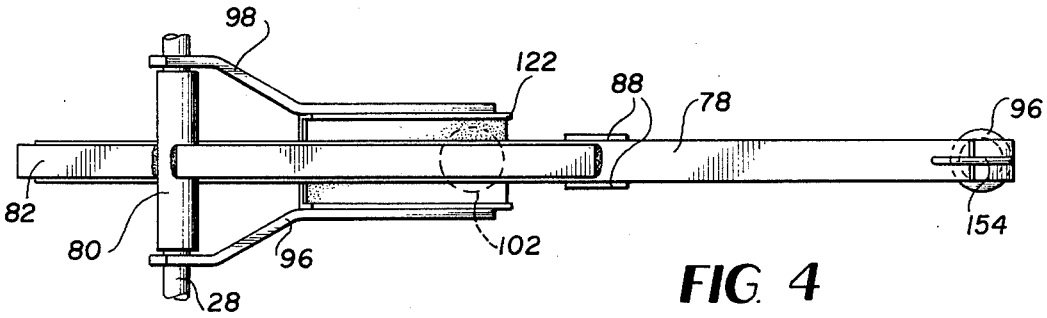
FIG. 4

BALL THROWING MACHINE USEFUL IN PRACTICING THE GAME OF VOLLEYBALL

BACKGROUND OF THE INVENTION

1. Field of the Invention

This invention relates to sports training apparatus and more particularly to a portable ball projecting apparatus for serving and setting balls for practice of the game of volleyball.

2. Description of the Prior Art

Ball serving and throwing machines are well known and are widely used in the practice of many sports such as baseball, softball and tennis. Such machines conventionally employ a motor which, acting through a speed reduction and/or force multiplying mechanism, retracts a throwing or striking arm against the force of a resilient biasing means, then releases the arm to propel the ball, either by impact or centrifugal force, along the desired trajectory. Pneumatic ball throwing devices are also known and are employed enabling players to effectively practice various aspects of games such as tennis, baseball, softball and volleyball.

It is also known to provide manually actuated ball throwing and/or serving mechanisms to enable a person unskilled in a particular game to effectively assist a player in practicing his game. One such machine is shown, for example, in U.S. Pat. No. 3,804,071 which discloses a volleyball practicing machine employing a pivoted, spring-biased, manually retracted ball striking arm. A plurality of pivots are provided on the machine for supporting the striking arm at different distances from the resilient biasing means to permit limited selective variation of the force delivered to the balls by the striking arm.

The known prior art volleyball projecting machines have not been entirely satisfactory for various reasons. For example, the known pneumatic volleyball serving machines generally have not been capable of adjustment to substantially vary the velocity and trajectory of the ball to enable the efficient use of the machine both to practice the return of a service and of spiking the ball, both of which are important aspects in the game of volleyball. The manually operable volleyball practice machines have also been unsatisfactory in that they require substantial physical labor and have been relatively slow in operation so that maximum utilization of the players practice time is not achieved.

It is, accordingly, a primary object of the present invention to provide an improved ball projecting apparatus capable of operation to project volleyballs along various trajectories and at various velocities to enable volleyball players to practice a variety of aspects of the game.

Another object of the present invention is to provide such a ball projecting apparatus which is relatively light in weight and easily movable by a single individual to facilitate storage and setting up of the apparatus.

Another object of the invention is to provide such a ball projecting apparatus having improved means for varying the trajectory and velocity of a ball projected from the apparatus.

SUMMARY OF THE INVENTION

In the attainment of the foregoing and other objects and advantages of the present invention, an important feature resides in providing a fully portable, relatively lightweight, fully automatic machine for projecting volleyballs, in a timed sequence, with variable force and along variable trajectories to enable the practice of various aspects of the game of volleyball from returning serves to spiking the ball. A readily accessible, crank-actuated screw thread adjustment provides infinite variation of the force delivered to the balls being served, within upper and lower limits.

The ball projecting machine is supported on a portable frame structure for pivotal movement about a horizontal axis, and readily accessible adjustment means are provided to permit quick and easy adjustment of the attitude of the apparatus. The balls are served from the apparatus by use of a striking arm actuated by an electric motor, operating through a gear reduction mechanism against the force of a spring, to deliver a series of balls, fed one at a time from a guide trough in a predetermined time sequence. If desired, a variable speed motor may be provided to enable adjustment of the frequency of delivery of the balls.

BRIEF DESCRIPTION OF THE DRAWINGS

The foregoing and other objects and advantages of the invention will become apparent from the detailed description contained hereinbelow, taken in conjunction with the drawings, in which:

FIG. 1 is a side elevation view of the volleyball projecting apparatus according to the present invention, with portions of the apparatus being shown in alternate positions in broken lines;

FIG. 2 is a fragmentary sectional view of a portion of the structure shown in FIG. 1, with certain elements illustrated in an alternate position;

FIG. 4 is an enlarged, fragmentary plan view of a portion of the structure shown in FIG. 3;

DESCRIPTION OF THE PREFERRED EMBODIMENT

Figure 3:
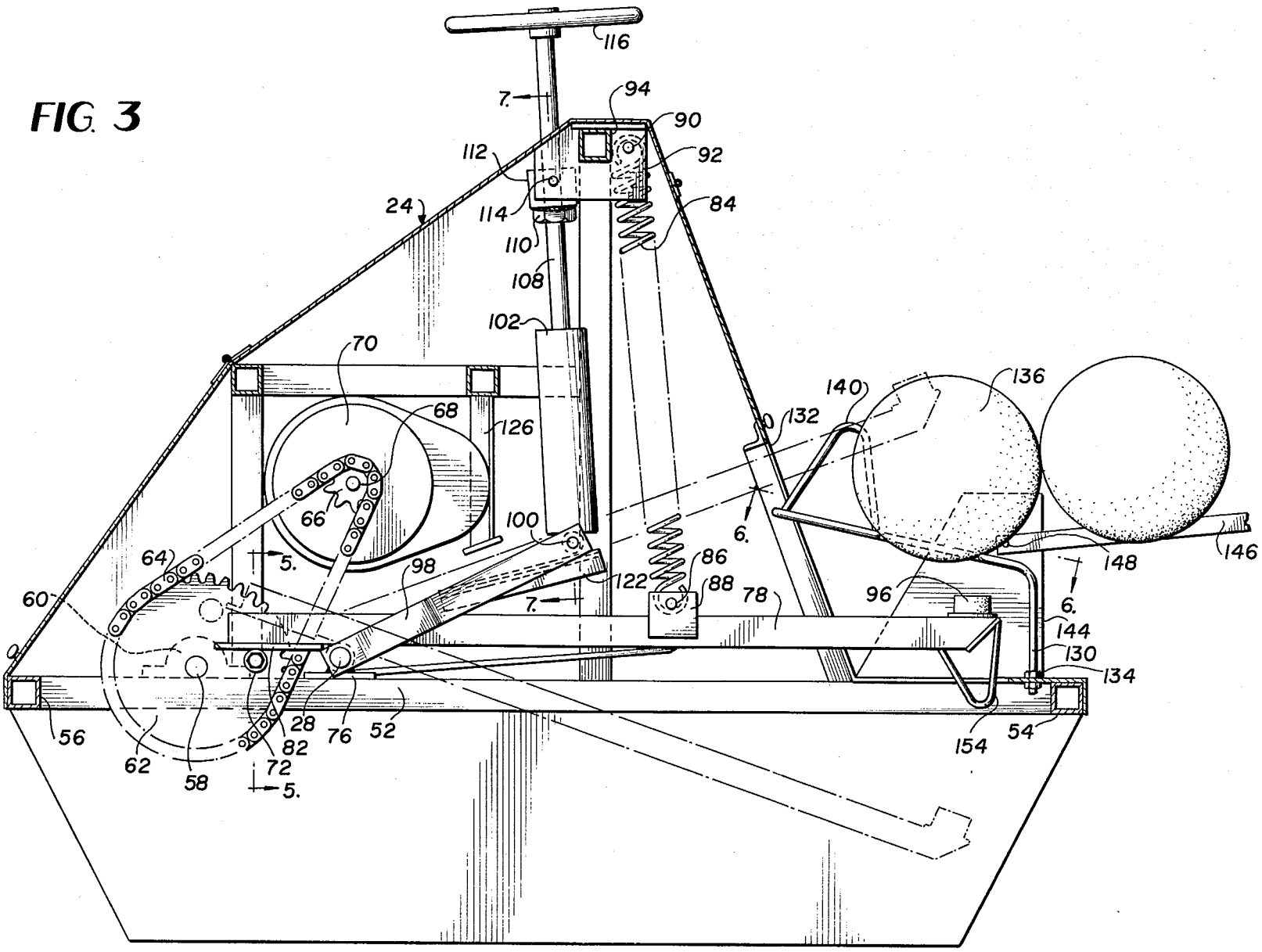
FIG. 3 is an enlarged elevation view, in section, of the ball projecting mechanism of the apparatus shown in FIG. 1.

Referring now to the drawings in detail, a volleyball projecting apparatus according to the present invention is designated generally by the reference numeral 10 and includes an open carriage frame 12 having back legs 14 and front legs 16 connected by laterally spaced, horizontal support beams 18, with only one back leg and front leg and one beam being shown in FIG. 1. A pair of brackets 20 are rigidly attached one to each of the front legs 16 and support a pair of wheels 22 for moving the apparatus. Wheels 22 may be spaced slightly above a supporting floor surface, or lightly touch the floor when the apparatus is in use, and to fully engage and support the front of the apparatus when the back is lifted, as by manually grasping the legs 14 and lifting, so that the entire apparatus can be easily moved in the manner of a wheelbarrow. Since wheels 22 do not support any substantial portion of the weight of the apparatus during normal use, the tendency of the device to move along the floor with vibration and the like is minimized. It is also contemplated that conventional, commercially available retractable wheels may be utilized.

Figure 8:
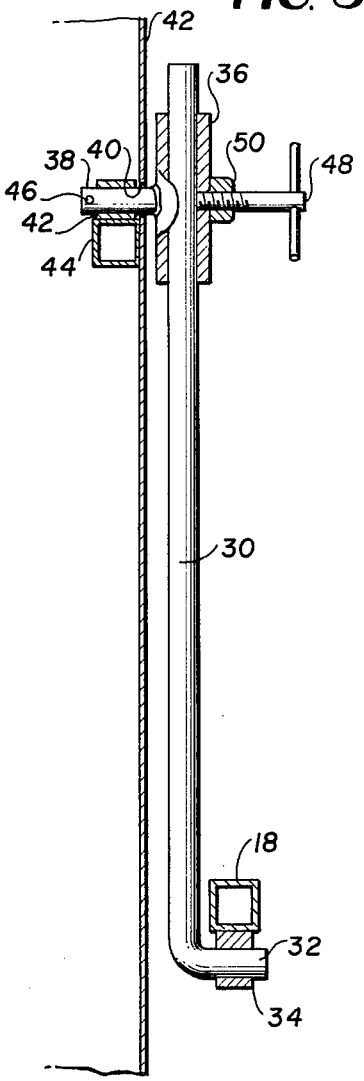
FIG. 8 is an enlarged fragmentary sectional view taken on line 8—8 of FIG. 1.

A closed housing 24 is supported on frame 12 for pivotal movement between a serving position shown in full line in FIG. 1 and a spiking position shown in broken lines in that figure. A pair of brackets 26 located one on each side of the support frame 12 on top of the horizontal beams 18 support a horizontally extending shaft 28 which projects from each side of the housing 24 to rotatably support the housing on the frame. Pivotal movement of the housing is limited by an adjusting mechanism including an elongated rod 30 best seen in FIG. 8.

The adjusting rod 30 has one end 32 bent at substantially a right angle to the longitudinal axis of the rod, with the angled end 32 being journaled in a block 34 rigidly supported on one of the horizontal beams 18 of frame 12. The other end portion of rod 30 is slidably received in a sleeve 36 supported by a shaft member 38 rigidly welded to and extending laterally from the body of the sleeve. Shaft 38 extends through an opening 40 in a side wall 42 of housing 24, and is journaled in a block 42 rigidly supported, as by welding, on a structural member 44 of the housing. Suitable means such as a cotter pin 46 releasibly retains the shaft against removal.

A T-shaped clamping member 48 is mounted in a threaded boss 50 on sleeve 36 at a position substantially opposite to shaft 38, with adjusting handle 48 being adapted to be turned into the sleeve to clamp the rod 30 to prevent sliding movement thereof through the sleeve 36 or, when released, to permit the rod to be moved to a desired position before reclamping. Thus, housing 24, and the volleyball machine supported therein, can easily be adjusted to any desired position on the frame 12 by releasing the T-handle 48 and pivoting the housing 24 about the shaft 28, then retightening the handle 48. The adjustment can easily be accomplished by a single person exerting very little effort.

Referring now to FIG. 3, it is seen that the housing 24 comprises a plurality of thin metal walls joined together to form a substantially complete enclosure supported by rigid internal framework constructed of welded structural members such as rectangular tubular members. The internal framework includes a substantially rectangular base made up of the structural member 44 and a laterally spaced parallel structural member 52, with members 44 and 52 being joined at their ends by parallel members 54, 56.

Figure 5:
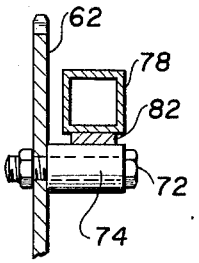
FIG. 5 is a fragmentary sectional view taken on line 5—5 of FIG. 3.
Figure 6:
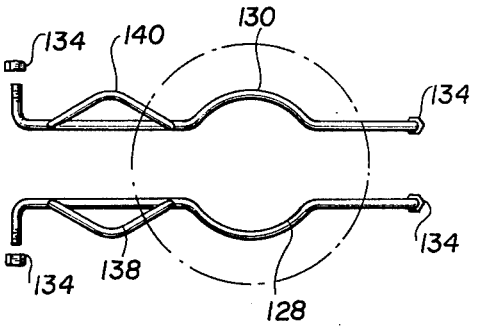
FIG. 6 is an enlarged, fragmentary view taken on line 6—6 of FIG. 3.

A shaft 58 extends transversely of housing 24 and is supported on structural members 44 and 52 by journal blocks 60. A large diameter sprocket 62 mounted on shaft 58 is driven by a chain 64 which, in turn, is driven by a small diameter sprocket 66 mounted on the output shaft 68 of an electric motor-gear reduction drive assembly 70. A roller cam 72 (see FIG. 5) is supported on one side face of sprocket 62 by a bolt 64 located at a point spaced substantially from the axis of rotation of the sprocket.

Shaft 28 extends completely through housing 24 and structural members 44 and 52 are mounted thereon by a pair of journal blocks 76. A ball striking arm 78 is mounted intermediate its ends on shaft 28 for pivotal movement therearound by a bearing sleeve 80. Arm 74 has one end projecting toward shaft 58, and a bearing plate 82 rigidly welded on the bottom surface of this projecting end is adapted to be engaged by the roller cam 72 upon rotation of sprocket 62 to pivot arm 78 about the axis of shaft 28 in a clockwise direction as viewed in FIG. 3. This pivotal movement is resisted by the tensile force of a long coil spring 84 having one end connected, by a pin 86 and bracket 88, to the arm 78 at a point spaced substantially from the shaft 28 on the side thereof opposite to the bearing plate 82. The opposite end of spring 84 is connected by pin 90 to a bracket 92 rigidly joined to the frame member 94 at the top of housing 24. A striking head 96, which may be in the form of a block of resilient material such as molded rubber, is mounted on and projects upwardly from the end of striking arm 78 in position to strike and project a volleyball from the machine upon counterclockwise rotation of the arm under influence of spring 84 as more fully described hereinbelow.

Figure 7:
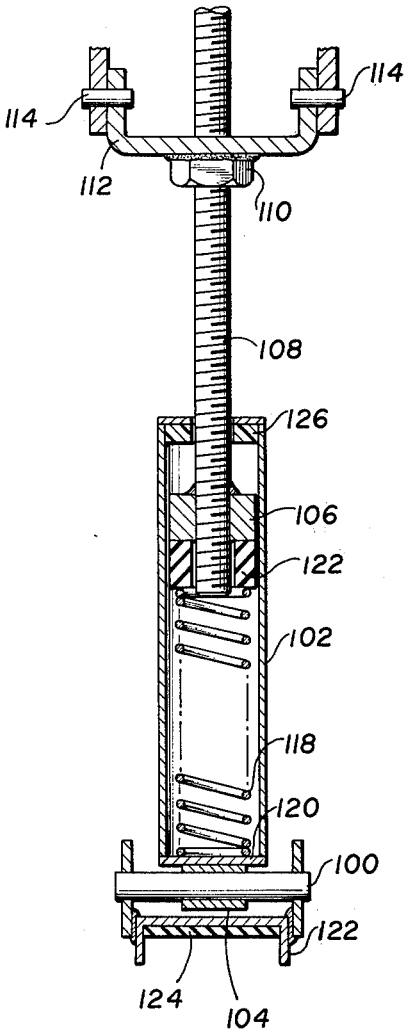
FIG. 7 is an enlarged, fragmentary sectional view taken on line 7—7 of FIG. 3.

In order to vary the force delivered to a volleyball by the apparatus, an adjustable, resilient stop means is provided to engage and limit the counterclockwise rotation of the striking arm. The adjustable force limiting mechanism includes a fork having a pair of arms 96, 98 each having one end pivotally mounted on shaft 28, one on each side of the bearing sleeve 80. As best seen in FIG. 7, an elongated cylinder 102 has one closed end pivotally connected, by sleeve 104 and pin 100, to the other ends of arms 96, 98. A piston 106 slidably mounted in cylinder 102 and rigidly joined, as by welding, to a threaded piston rod 108 which, in turn, is threadably received in a nut 110 rigidly welded to bracket 112. Bracket 112 is pivotally supported by a pair of pins 114 in the rigid bracket 92.

As shown in FIGS. 1 and 3, the threaded piston rod 108 extends upwardly through the top portion of housing 24 and has a hand wheel 116 rigidly mounted thereon in position easily accessible for manual adjustment of the apparatus. A coil spring 118 is supported within the cylinder 102 between the closed bottom end 120 and a bearing block 122 slidalby received in the cylinder and bearing against the piston 106. Thus, rotation of the hand wheel 116 in one direction will project the lower end of the rod 108 through the threaded nut 116 to urge the bottom of the cylinder and consequently the arms 96, 98 downward. Conversely, rotation of hand wheel 116 in the opposite direction will rotate the fork assembly in a counterclockwise direction, as seen in FIG. 3, to lift the movable end of the arms 96, 98.

A stop member in the form of a channel 122 is rigidly welded between the arms 96, 98 in position to engage the top surface of arm 78 substantially along the full length of the channel upon rotation of the arm 78 in the counterclockwise direction under the force of spring 84. A resilient, rubber-like pad 24 is bonded to the bottom surface of the web portion of channel 122 to provide a cushioning effect and to reduce noise upon the arm 78 striking the adjustable force limiting mechanism. A rigid stop member 126 is positioned on the frame to engage the top surface of channel 122 to provide a secondary stop, positively limiting rotation of the arm 78 in the counterclockwise direction. It is noted that the end of arm 78 having the striker head 96 thereon projects outwardly through an opening in the housing 24 to strike a ball, and the stop 126 limits movement of the arm 78 to prevent it from striking the housing.

The piston 106 is dimensioned to provide a slight clearance between its cylindrical side walls and the adjacent side walls of cylinder 102 to provide a restricted air passage around the piston upon movement of the cylinder 102 either upward or downward along the threaded rod 108. The resistance to the flow of air from the lower, sealed portion of the cylinder upon upward movement provides a dash-pot effect assisting the compression spring in absorbing energy from the striking arm 78. Similarly, the limited clearance restricts the flow of air back into the bottom portion of the cylinder upon downward movement under influence of the spring 118 after the impact of the striking arm. This dash-pot effect helps to prevent excessive rebound. In this regard, resilient means such as a soft rubber washer 126, or a lightweight coil spring is preferably provided in the top of the cylinder 102 to reduce the impact and noise as the top portion of the cylinder contacts the top of the piston in the normal relaxed state of the impact absorbing apparatus.

A pair of contoured bar elements 128, 130 are mounted on the housing 24 one adjacent each side of the striker arm opening 132. Contoured bar members 128, 130 are rigidly retained in position by suitable means such as nuts 134, and cooperate with one another to define a ball positioning rack which supports a volleyball 136 in a striking position in the path of the striking head 96. A pair of stops 138, 140 respectively formed on the bar members 128, 130 prevent a volleyball from rolling from the striking position, regardless of the attitude of the apparatus within the limits of adjustment of the bar 30, so that the striking head 96 always strikes a ball 136 at the same relative position.

A pair of upstanding brackets 142, 144 are rigidly welded to the housing 24, one spaced outwardly from each of the contoured ball support bars 128, 130. An elongated ball supply trough 146 has one end pivotally connected to the brackets 142, 144, as by pins 148, at points spaced slightly above and outward from the ball striking position. The other end of the guide trough 146 is supported by an elongated leg 150 having one end pivotally connected to the trough by a hinge bracket 152 and its other end supported on the floor by a resilient, high friction tip 154.

In use of the apparatus according to the present invention, the electric motor-reduction gear drive 70 is started, by use of suitable controls such as a simple on-off switch in an electric circuit to the motor. Operation of the motor drives the large sprocket wheel 62 in a counterclockwise direction as seen in FIG. 3 at a relatively slow rate. Prior to operation of the motor, the striking arm is in the fully raised position shown in phantom line in FIG. 3. As sprocket 62 rotates, cam 72 contacts the bearing plate 82 on the end of striker arm 78 and rolls therealong as the sprocket continues to rotate to move the striker arm about shaft 26 to lower the striking head to the lower phantom line position shown in FIG. 3. When the roller cam passes off the end of plate 82, spring 84, which has been extended by movement of the striker arm, immediately swings the striker arm upward to bring the striker head 96 into contact with a ball positioned on the support arms.

Depending upon the position of the adjustable stop mechanism, the top surface of striker arm 78 will come into contact with the resilient pad 124 somewhere between a position just prior to the striker head contacting the ball to deliver a minimum striking force and a position substantially above the point of contact of the striker head with the ball to deliver maximum striking force and ball velocity. As the first ball 136 is propelled from the apparatus, the next ball in position on the guide trough 146 tends to roll, by gravity, into the striking position. To prevent a subsequent ball from entering the striking position before return of the striker arm, a ball stop member 154 is welded to and projects downwardly from the end of the striking arm 78 in position to engage a ball on the guide trough and prevent it from moving beneath the striker arm.

After the initial ball has been propelled from the apparatus, the striker arm will tend to come to rest at a position somewhere near the upper phantom line position shown in FIG. 3, with the exact position depending upon the adjusted position of the stop mechanism. In the at-rest position, the force of spring 84 counterbalances the combined force of spring 118 and the weight of the adjusting mechanism and striker arms. This at-rest position normally is sufficiently high to prevent a volleyball from rolling into the striking position until the next revolution of sprocket 62 engages cam 72 with the arm to move it downwardly to repeat the cycle. If desired, the power circuit to the motor drive can include timing means to assure stopping of the striking arm in this raised position.

Once operation of the apparatus is started, and a supply of volleyballs is provided in the guide trough, the desired delivery force can easily be adjusted by simply turning the hand wheel 116. When the desired force is obtained, the trajectory can be adjusted by simply loosening the T-handle 48 and tilting the entire apparatus about the shaft 28 and then retightening the T-handle. The balance of the apparatus about shaft 28 is such that very little effort is required to adjust its position and little force is required to retain the apparatus in the desired adjusted position. Thus, minor adjustments of the trajectory and/or velocity of the balls propelled from the apparatus can readily be made with a minimum of time and effort. Further, the pivotally supported guide chute automatically adjusts to the attitude of the apparatus without requiring any movement of the support leg.

Various modifications to the apparatus described can readily be made without departing from the spirit of the invention. For example, the electric motor employed in the drive train may be a variable speed motor to enable variation of the time interval between ball deliveries. Also, if desired, the stop members 138, 140 may be provided with a high friction surface which engages and applies a drag to one side of the ball to spin the ball as it is projected from the apparatus. Alternatively, other ball engaging means having such a high friction surface may be provided. Other cam arrangements may be provided for retracting the striking arm against the resilient force of the spring 84. Thus, while preferred embodiments of the invention have been disclosed and described in detail, we wish it understood that we do not intend to be restricted solely thereto, but rather that we do intend to include all embodiments thereof which would be apparent to one skilled in the art and which come within the spirit and scope of our invention.

We claim:

1. A volleyball projecting apparatus comprising a support frame including a plurality of legs for supporting the apparatus on a floor surface and wheel means mounted on said frame and engageable with a floor surface for supporting the frame for movement over the floor, a machine housing having an opening in a wall thereof, horizontal shaft means supporting said housing on said frame for pivotal movement between a first position useful in the practice of ball spiking and a second position useful in the practice of returning serves, adjustable clamping means extending between said housing and said frame for releasably clamping said housing at said first and second positions and at any rotative position therebetween, an elongated striking arm having ball striking means adjacent one end thereof, means mounting said arm within said housing for pivotal movement about an axis parallel to the axis of said horizontal shaft means, biasing means mounted within said housing and resiliently urging said arm to a fully raised position in which said one end projects outward through said opening, motor drive means within said housing and operable to periodically move said arm to a fully lowered position against the resistance of said biasing means and to release said arm at said lowered position to be forcefully returned to the raised position by said biasing means, ball support means for supporting a volleyball at a striking station in position to be struck by said striking means upon movement of said arm from the fully lowered to the fully raised position, and adjustable resilient force limiting means for selectively varying the force delivered to a ball at the striking station by said striking means adjustable means for adjusting the position of the force limiting means, said adjustable means being operable to variably position the limiting means relative to said arm.

2. The volleyball projecting apparatus defined in claim 1 wherein said frame comprises a pair of horizontal, laterally spaced bar members supported on said legs above a floor surface, and wherein said housing is supported on said horizontal bar members for pivotal movement about a horizontal axis extending therebetween.

3. The volleyball projecting apparatus defined in claim 2 wherein said force limiting means comprises resilient stop means within said housing in position to engage and stop movement of said arm at said fully raised position, and means for selectively adjusting the position of said resilient stop means and thereby the location of the fully raised position.

4. The volleyball projecting apparatus defined in claim 3 wherein said housing and said striking arm are pivotally mounted on a common horizontal shaft member.

5. The volleyball projecting apparatus defined in claim 4 further comprising ball feed means for feeding volleyballs one at a time to said striking station.

6. The volleyball projecting apparatus defined in claim 5 wherein said ball feed means comprises an elongated guide trough having one end supported on said housing and leg means supporting the other end at a position above said one end whereby volleyballs positioned in the trough will roll, by gravity, along the trough to said striking position regardless of the rotative position of said housing between said first and second positions.

7. The volleyball projecting apparatus defined in claim 6 wherein said ball feed means further comprises ball stop means on said arm for preventing a volleyball from moving to said striking position when said arm is in said raised position.

8. The volleyball projecting apparatus defined in claim 7 wherein said resilient stop means comprises a piston supported within a cylinder, a threaded rod connected with said piston, a pivoted bracket threadably engaging said threaded rod and supported on said housing, resilient means within said cylinder normally urging said piston in a direction to project said threaded rod from the cylinder and stop means connected to the other end of said cylinder, said stop means being retained by said cylinder in position to engage said arm upon movement thereof from the fully lowered to the fully raised position.

9. The volleyball projecting apparatus defined in claim 8 wherein said stop means comprises an elongated stop member having one end pivotally supported on said cylinder and its other end pivotally supported for movement about the axis of rotation of said arm.

10. The volleyball projecting apparatus defined in claim 1 wherein said adjustable force limiting means comprises resilient stop means including a piston supported within a cylinder, a threaded rod connected with said piston, a bracket threadably engaging said threaded rod and supported on said housing, resilient means within said cylinder normally urging said piston in a direction to project said threaded rod from the cylinder, stop means connected to the other end of said cylinder, said stop means being retained by said cylinder in position to engage said arm upon movement thereof from the lowered to the raised position, and means for rotating said threaded rod relative to said bracket to thereby vary the position of the stop means.

11. The volleyball projecting apparatus defined in claim 10 wherein said stop means comprises an elongated stop member having one end pivotally supported on said cylinder and its other end pivotally supported for movement about the axis of rotation of said arm.

12. A volleyball projecting apparatus comprising a support frame including supporting the apparatus on a floor surface, a machine housing having an opening in a wall thereof, horizontal shaft means supporting said housing on said frame for pivotal movement between a first position useful in the practice of ball spiking and a second position useful in the practice of returning serves, adjustable clamping means extending between said housing and said frame for releasably clamping said housing at said first and second positions and at any rotative position therebetween, an elongated striking arm having ball striking means adjacent one end thereof, means mounting said arm within said housing for pivotal movement about an axis parallel to the axis of said horizontal shaft means, biasing means mounted within said housing and resiliently urging said arm to a fully raised position in which said one end projects outward through said opening, motor drive means within said housing and operable to periodically move said arm to a fully lowered position against the resistance of said biasing means and to release said arm at said fully lowered position to be forcefully returned to the fully raised position by said biasing means, ball support means for supporting a volleyball at a striking station in position to be struck by said striking means upon movement of said arm from the lowered to the raised position, and adjustable force limiting means for selectively varying the force delivered to a ball at the striking station by said striking means upon movement of said arm from the fully lowered to the fully raised position, the force limiting means including, a piston supported within a cylinder, a threaded rod connected with said piston, bracket means supported on said housing and threadably engaging said threaded rod, resilient means within said cylinder normally urging said piston in a direction to project said threaded rod from the cylinder, stop means connected to the other end of said cylinder, said stop means being retained by said cylinder in position to engage and arrest movement of said arm upon movement thereof from the fully lowered to the fully raised position, and means for adjusting the position of said threaded rod relative to said bracket means to thereby adjust the position of said stop means and the location of the fully raised position.

13. The volleyball projecting apparatus defined in claim 12 wherein said stop means comprises an elongated stop member having one end pivotally supported on said cylinder and its other end pivotally supported for movement about the axis of rotation of said arm.

14. The volleyball projecting apparatus defined in claim 13 further comprising ball feed means for feeding volleyballs one at a time to said striking station, said ball feed means including, an elongated guide trough having one end supported on said housing and leg means supporting the other end at a position above said one end whereby volleyballs positioned in the trough will roll, by gravity, along the trough to said striking position regardless of the rotative position of said housing between said first and second positions.

15. The volleyball projecting apparatus defined in claim 14 wherein said ball feed means further comprises ball stop means on said arm for preventing a volleyball from moving to said striking position when said arm is in said fully raised position.

* * * * *